US011538341B2

(12) United States Patent
Franke et al.

(10) Patent No.: US 11,538,341 B2
(45) Date of Patent: Dec. 27, 2022

(54) METHODS, DEVICES AND COMPUTER-READABLE STORAGE MEDIUM COMPRISING INSTRUCTIONS FOR DETERMINING APPLICABLE TRAFFIC REGULATIONS FOR A MOTOR VEHICLE

(71) Applicant: Volkswagen Aktiengesellschaft, Wolfsburg (DE)

(72) Inventors: Kai Franke, Stendal (DE); Stephan Max, Gifhorn (DE); Peter Baumann, Braunschweig (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 147 days.

(21) Appl. No.: 16/611,320

(22) PCT Filed: Apr. 26, 2018

(86) PCT No.: PCT/EP2018/060649
§ 371 (c)(1),
(2) Date: Nov. 6, 2019

(87) PCT Pub. No.: WO2018/215156
PCT Pub. Date: Nov. 29, 2018

(65) Prior Publication Data

US 2020/0143679 A1 May 7, 2020

(30) Foreign Application Priority Data

May 24, 2017 (DE) ..... 10 2017 208 854.0

(51) Int. Cl.
*G08G 1/127* (2006.01)
*G08G 1/01* (2006.01)

(52) U.S. Cl.
CPC ..... *G08G 1/127* (2013.01); *G08G 1/0129* (2013.01); *G08G 1/0133* (2013.01)

(58) Field of Classification Search
CPC ..... G08G 1/127; G08G 1/0129; G08G 1/0133
(Continued)

(56) References Cited

U.S. PATENT DOCUMENTS 5,999,877 A * 12/1999 Takahashi ..... G06V 20/54 340/916
7,317,973 B2 * 1/2008 Dieterle ..... G08G 1/096741 701/23
(Continued)

FOREIGN PATENT DOCUMENTS

DE 10210546 A1 9/2003 ..... B60K 31/00
DE 102007034505 A1 1/2009 ..... G06K 9/62
(Continued)

OTHER PUBLICATIONS

German Office Action, Application No. 102017208854.0, 7 pages, dated Feb. 15, 2018.
(Continued)

*Primary Examiner* — Kerri L McNally
*Assistant Examiner* — Thang D Tran
(74) *Attorney, Agent, or Firm* — Slayden Grubert Beard PLLC

(57) ABSTRACT

Methods, devices and a computer-readable medium comprising instructions for determining applicable traffic regulations for a motor vehicle are provided. In some embodiments, the position and direction of movement of the motor vehicle are determined. The position and direction of movement of the motor vehicle are then transmitted to a back end by a transmission apparatus of the motor vehicle. In response to the information transmitted to the back end, information concerning traffic regulations applicable to the
(Continued)

position of the motor vehicle is received by the transmission apparatus. The transmission of the position and direction of movement of the motor vehicle to the back end is carried out in a cyclical manner or in accordance with information concerning the validity of the traffic regulations, which is included in the information concerning the traffic regulations applicable at the position of the motor vehicle.

20 Claims, 7 Drawing Sheets

(58) Field of Classification Search
USPC ..... 701/117
See application file for complete search history.

(56) References Cited

U.S. PATENT DOCUMENTS 7,491,009 B1 * 2/2009 Remy ..... E01C 1/04 404/1
8,643,721 B2 * 2/2014 Becker ..... G06K 9/00818 348/148
8,676,500 B1 * 3/2014 Walsh ..... G06Q 50/30 701/437
9,459,623 B1 * 10/2016 Raghu ..... G01S 13/931
9,539,901 B1 * 1/2017 Clauss ..... G01C 21/3697
9,697,430 B2 7/2017 Kristensen
2004/0102898 A1 * 5/2004 Yokota ..... G01C 21/3691 701/414
2004/0158366 A1 * 8/2004 Dieterle ..... B60K 31/0058 701/23
2005/0099321 A1 * 5/2005 Pearce ..... G08G 1/123 340/995.13
2005/0140523 A1 * 6/2005 Publicover ..... G08G 1/095 340/901
2008/0069000 A1 * 3/2008 Muck ..... G08G 1/0104 370/236.1
2008/0300733 A1 * 12/2008 Rasshofer ..... G08G 1/167 701/1
2009/0024320 A1 * 1/2009 Nakamura ..... G08G 1/096844 701/414
2009/0060648 A1 * 3/2009 Remy ..... E01C 1/04 404/1
2009/0148233 A1 * 6/2009 Remy ..... E01C 1/04 404/1
2009/0224942 A1 * 9/2009 Goudy ..... G08G 1/096783 340/905
2010/0007523 A1 * 1/2010 Hatav ..... G08G 1/166 340/901
2010/0117861 A1 * 5/2010 Free ..... G08G 1/0104 340/929
2010/0188265 A1 * 7/2010 Hill ..... G08G 1/0133 340/905
2010/0198454 A1 * 8/2010 Sugawara ..... G08G 1/20 701/31.4
2011/0083011 A1 * 4/2011 DiCrescenzo ..... H04L 63/0823 713/158
2011/0210867 A1 * 9/2011 Benedikt ..... G08G 1/096741 340/905
2011/0234423 A1 * 9/2011 Edwardson ..... G08G 1/087 340/906
2012/0218126 A1 * 8/2012 Roberts ..... G08G 1/087 340/906
2012/0249343 A1 * 10/2012 Thomas ..... G08G 1/096783 340/905
2013/0311038 A1 * 11/2013 Kim ..... G08G 1/096716 701/1
2013/0345954 A1 * 12/2013 Tashiro ..... G08G 1/00 701/117
2014/0114502 A1 * 4/2014 Hugron ..... G07C 5/008 701/2
2015/0022378 A1 * 1/2015 Hahne ..... G08G 1/0962 340/933
2015/0077270 A1 * 3/2015 Rubin ..... G08G 1/161 340/903
2015/0111599 A1 * 4/2015 Yamasaki ..... H04W 4/40 455/456.1
2015/0211875 A1 * 7/2015 Alduaiji ..... G01C 21/3492 701/487
2016/0003632 A1 * 1/2016 Masuda ..... H04N 21/422 701/522
2016/0023656 A1 * 1/2016 Matsumura ..... B60W 50/085 701/93
2016/0061625 A1 * 3/2016 Wang ..... G06Q 30/0214 701/454
2016/0091324 A1 * 3/2016 Horihata ..... G08G 1/096811 701/417
2016/0150070 A1 * 5/2016 Goren ..... G06K 9/00805 455/404.2
2016/0167582 A1 * 6/2016 Chen ..... G01C 21/32 348/148
2016/0232785 A1 * 8/2016 Wang ..... G08G 1/096816
2016/0275792 A1 * 9/2016 Takiguchi ..... G06V 20/582
2017/0039850 A1 * 2/2017 Vanden Berg ..... B60Q 9/00
2017/0122763 A1 5/2017 Meier et al. ..... 701/450
2017/0124476 A1 * 5/2017 Levinson ..... G01S 17/931
2017/0131719 A1 * 5/2017 Micks ..... B60W 60/0027
2017/0240185 A1 * 8/2017 Li ..... G08B 7/06
2017/0278390 A1 * 9/2017 Zydek ..... G08G 1/096716
2018/0108252 A1 * 4/2018 Pividori ..... G07C 5/085
2018/0113450 A1 * 4/2018 Sherony ..... G01C 21/3691
2018/0118219 A1 * 5/2018 Hiei ..... B60W 40/09
2018/0134282 A1 * 5/2018 Freienstein ..... G08G 1/096725
2018/0151065 A1 * 5/2018 Liu ..... G08G 1/096791
2018/0174446 A1 * 6/2018 Wang ..... G08G 1/017
2018/0191551 A1 * 7/2018 Chun ..... H04L 67/12
2018/0273048 A1 * 9/2018 Perez Barrera ..... B60W 40/04
2018/0300567 A1 * 10/2018 Qin ..... G06K 9/00825
2018/0312161 A1 * 11/2018 Asakura ..... B60W 10/18
2018/0345981 A1 * 12/2018 Ferguson ..... G07C 5/0808
2018/0364715 A1 * 12/2018 Greenberger .... G08G 1/096741
2019/0063931 A1 * 2/2019 Aoyama ..... G08G 1/005
2019/0098470 A1 * 3/2019 Yu ..... H04W 4/46
2019/0310091 A1 * 10/2019 Maeda ..... G01C 21/30
2019/0311614 A1 * 10/2019 Yang ..... G05D 1/0246
2019/0311621 A1 * 10/2019 Pedersen ..... G08G 1/0962
2019/0324464 A1 * 10/2019 Yang ..... G05D 1/0214

FOREIGN PATENT DOCUMENTS

DE 102008043756 A1 5/2010 ..... B60R 16/02
DE 102012200182 A1 7/2013 ..... G07C 5/08
DE 102013003798 A1 9/2014 ..... B60W 30/08
DE 102013013799 A1 2/2015 ..... B60W 50/14
DE 102013219909 A1 4/2015 ..... G06K 9/62
DE 102013225497 A1 6/2015 ..... G01C 21/26
DE 102015008553 A1 2/2016 ..... B06R 11/04
DE 102014219418 A1 3/2016 ..... B60R 1/00
DE 102014219423 A1 3/2016 ..... B60R 1/00
DE 102015219467 A1 4/2016 ..... G06Q 50/30
DE 102017208854 A1 11/2018 ..... G08G 1/0967
EP 2843639 A1 3/2015 ..... G08G 1/01
WO 2011/044922 A1 4/2011 ..... B60W 30/08
WO 2016/000919 A1 1/2016 ..... G06T 7/00
WO 2018/215156 A1 11/2018 ..... G08G 1/0967

OTHER PUBLICATIONS

International Search Report and Written Opinion, Application No. PCT/EP2018/060649, 10 pages, dated Jul. 25, 2018.
European Office Action, Application No. 18720587.7, 10 pages, dated Jan. 3, 2022.

* cited by examiner

METHODS, DEVICES AND COMPUTER-READABLE STORAGE MEDIUM COMPRISING INSTRUCTIONS FOR DETERMINING APPLICABLE TRAFFIC REGULATIONS FOR A MOTOR VEHICLE

CROSS-REFERENCE TO RELATED APPLICATIONS

This application claims priority to German Patent Application No. DE 10 2017 208 854.0, filed on May 24, 2017 with the German Patent and Trademark Office. The contents of the aforesaid Patent Application are incorporated herein for all purposes.

TECHNICAL FIELD

The present invention relates to methods, devices and a computer-readable storage medium comprising instructions for determining applicable traffic regulations for a motor vehicle. The invention further relates to a motor vehicle in which a method according to the invention or device according to the invention is used.

BACKGROUND

In modern vehicles, the driver is often given information about road signs on the side of the road or about currently applicable speed limits or restrictions on overtaking, in that this information is displayed on a screen instrument or head-up display in the vehicle, for example. Furthermore, this information can also be used by different controllers in the vehicle, for example to automatically control the vehicle speed or to warn of unauthorized overtaking maneuvers. In the context of autonomous or semi-autonomous driving, it is essential that this information is always available.

At present, there are substantially two approaches for providing information on road signs or traffic regulations currently applicable to a vehicle. A first approach is based on the use of navigation maps, in which road signs are marked. A second approach consists of recognizing road signs using camera systems.

For example, DE 10 2013 013 799 A1 describes an assistance system which assists a vehicle driver during an overtaking procedure by determining whether the overtaking procedure can be fully executed without posing any danger based on the speed difference with respect to a vehicle to be overtaken and in consideration of the remaining overtaking distance. The remaining overtaking distance can be determined by means of road sign recognition or GPS-based map material.

DE 10 2007 034 505 A1 describes a method for recognizing road signs. This road sign recognition method is based on the image data provided and uses a country-specific road sign database containing at least some country-specific classification features or at least some country-specific classification methods. If the road sign recognition is of low quality, the road sign recognition is repeated using another alternative country-specific road sign database with the help of saved image regions comprising detected road signs. This is repeated until the result of the road sign recognition is of sufficient quality. The country-specific road sign database that was used in a road sign recognition procedure of at least sufficient quality is then preset for other road sign recognition procedures.

A method for providing road sign information is known from DE 10 2008 043 756 A1. In a first step, road sign data are stored in the vehicle. Subsequently, stored road sign data are assigned to a current position of a vehicle. Road sign information is then finally provided on the basis of the road sign data assigned to the current position of the vehicle. Some of the road sign data can be queried from an online service on the basis of information relating to the position of the vehicle.

A disadvantage of camera-based solutions is their limited range, i.e., detection of road signs in advance is only possible to a limited extent. In addition, the reliability of the recognition decreases with increasing vehicle speed.

A disadvantage of solutions that are based on navigation maps is that these maps must always be up-to-date, and therefore the maps have to be continuously updated, for example by means of online updates. The maps required incur licensing costs and are generally only sold together with a navigation function. This incurs additional costs on the user.

SUMMARY

An object thus exists to present solutions for determining applicable traffic regulations for a motor vehicle that enable reliable provision of the desired information without a map having to be kept in the motor vehicle.

This object is solved by a method, a computer-readable storage medium, and by a device having the features of the independent claims. Embodiments of the invention are the subject matter of the dependent claims and the following description.

DETAILED DESCRIPTION

Figure 1:
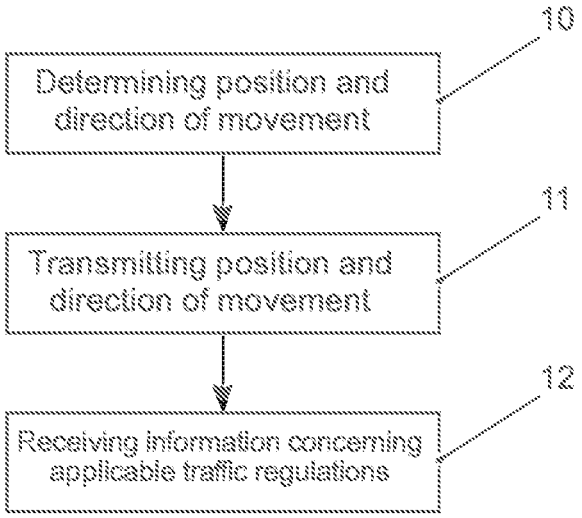
FIG. 1 schematically shows a method for determining applicable traffic regulations for a motor vehicle from the perspective of the motor vehicle.

According to a first aspect, a method for determining applicable traffic regulations for a motor vehicle comprises the steps of:

transmitting at least one position and one direction of movement of the motor vehicle to a back end by means of a transmission apparatus of the motor vehicle; and receiving information concerning the traffic regulations applicable at the position of the motor vehicle by means of the transmission apparatus;

the transmission of at least one position and one direction of movement of the motor vehicle to the back end being carried out in a cyclical manner or in accordance with information concerning the validity of the traffic regulations, which is included in the information concerning the traffic regulations applicable at the position of the motor vehicle.

According to another aspect, a computer-readable storage medium contains instructions that, when executed by a computer, cause the computer to execute the following steps for determining applicable traffic regulations for a motor vehicle:

transmitting at least one position and one direction of movement of the motor vehicle to a back end by means of a transmission apparatus of the motor vehicle; and receiving information concerning the traffic regulations applicable at the position of the motor vehicle by means of the transmission apparatus;

the transmission of at least one position and one direction of movement of the motor vehicle to the back end being carried out in a cyclical manner or in accordance with information concerning the validity of the traffic regulations, which is included in the information concerning the traffic regulations applicable at the position of the motor vehicle.

The term "computer" used herein is to be interpreted broadly. For example, it also encompasses controllers and other processor-based data processing devices.

According to another aspect, a device for determining applicable traffic regulations for a motor vehicle comprises:

a transmission apparatus for transmitting at least one position and one direction of movement of the motor vehicle to a back end and for receiving information concerning the traffic regulations applicable at the position of the motor vehicle; and a data processing unit for evaluating the information concerning the traffic regulations applicable at the position of the motor vehicle;

the transmission apparatus being configured to carry out the transmission of at least one position and one direction of movement of the motor vehicle to the back end in a cyclical manner or in accordance with information concerning the validity of the traffic regulations, which is included in the information concerning the traffic regulations applicable at the position of the motor vehicle.

In the context of a method that may be used in a motor vehicle or respectively a device that may be installed in a motor vehicle, only the position and direction of movement of the motor vehicle are detected and transmitted to a back end. The back end determines information concerning the applicable traffic regulations based on this information, and this determined information is then transmitted to the motor vehicle. The motor vehicle therefore does not require a sensor system for detecting road signs or special, continuously updated map information, which results in significant cost savings. The traffic regulations may be queried either in a cyclical manner, i.e., at regular temporal or spatial intervals, or in accordance with information concerning the validity of the traffic regulations. This way, only manageable volumes of data need to be transmitted in order for the data transmission between motor vehicle and back end to be highly efficient.

According to an embodiment, a history of positions of the motor vehicle is transmitted to the back end. The history of positions, i.e., a trace of past waypoints, is extremely helpful for correct assignment of the vehicle position to a road, such as to the correct driving lane in the case of multi-lane roads.

According to another aspect, a method for determining applicable traffic regulations for a motor vehicle comprises the following steps:

receiving at least one position and one direction of movement of the motor vehicle;

determining information concerning the traffic regulations applicable at the position of the motor vehicle; and transmitting the information concerning the traffic regulations applicable at the position of the motor vehicle to the motor vehicle;

the information concerning the traffic regulations applicable at the position of the motor vehicle comprising information concerning the validity of the traffic regulations.

According to another aspect, a computer-readable storage medium contains instructions that, when executed by a computer, cause the computer to execute the following steps for determining applicable traffic regulations for a motor vehicle:

receiving at least one position and one direction of movement of the motor vehicle;

determining information concerning the traffic regulations applicable at the position of the motor vehicle; and transmitting the information concerning the traffic regulations applicable at the position of the motor vehicle to the motor vehicle;

the information concerning the traffic regulations applicable at the position of the motor vehicle comprising information concerning the validity of the traffic regulations.

The term "computer" is to be interpreted broadly here as well. For example, it also encompasses work stations, distributed systems and other processor-based data processing devices.

According to another aspect of the present aspect, a device for determining applicable traffic regulations for a motor vehicle has:

a transmission apparatus for receiving at least one position and one direction of movement of the motor vehicle and for transmitting information concerning the traffic regulations applicable at the position of the motor vehicle to the motor vehicle; and a computing unit for determining the information concerning the traffic regulations applicable at the position of the motor vehicle;

the computing unit being configured to provide the information concerning the traffic regulations applicable at the position of the motor vehicle with information concerning the validity of the traffic regulations.

In the context of a method that may be used in a back end or respectively a device that may be installed in a back end, only the position and direction of movement of a motor vehicle are received by the back end. The back end determines information concerning the applicable traffic regulations based on this information, and this determined information is then transmitted to the motor vehicle. In order to keep the required volume of data small, the back end also determines information concerning the validity of the traffic regulations and transmits same to the motor vehicle. The traffic regulations may then be queried by means of the motor vehicle based on the validity, such that no more queries need to be sent to the back end.

According to an embodiment, the determination of the information concerning the traffic regulations applicable at the position of the motor vehicle comprises the steps of:

assigning the position of the motor vehicle to a road in a road network;

determining traffic regulations applicable to the road at the position of the motor vehicle; and determining at least one distance within the road network until a change in the applicable traffic regulations.

After the position of the motor vehicle has been assigned to a road in a road network, i.e., in a map, the desired information concerning the traffic regulations may immediately be extracted from the map data. In addition, possible travel routes may be checked for changes in traffic regulations using the map. As a result, it is easy to determine up to which future vehicle positions no query of the traffic regulations by the motor vehicle is required.

According to an embodiment, the information concerning the validity of the traffic regulations comprises an indicator that the position of the motor vehicle is in or adjacent to a region of an intersection. An increased cycle frequency may for example be used for the transmission of the position and direction of movement of the motor vehicle to the back end in the presence of the indicator. This approach increases the reliability of the described solutions in regions of intersections.

According to an embodiment, the information concerning the validity of the traffic regulations relates to a geographical validity, such as for example a geographical validity that depends on a travel route. The transmission of at least one position and one direction of travel of the motor vehicle to the back end is in this case carried out again when the geographical validity ceases to apply. This approach requires a very small number of queries, and therefore the volume of data accrued is very small. In addition, no permanent data connection is required. The geographical validity may for example be defined by the minimum distance until a change in the traffic regulations, however several distances for various possible routes may also be transmitted.

According to an embodiment, the information concerning the traffic regulations applicable at the position of the motor vehicle comprises detailed information relating to at least one intersection. By virtue of this detailed information, e.g., relating to an intersection model or intersection network, a certain degree of pre-emption is possible in the event of latencies in the back end querying process, as a result of which the reliability of the method is increased further.

According to an embodiment, the traffic regulations applicable at the position of the motor vehicle relate to a speed limit, a right of way or a restriction on overtaking. This way, typical examples of traffic regulations that apply over longer street sections and that are therefore particularly suitable for use in the solutions described are covered.

In some embodiments, a method according to the disclosure herein or a device according to the disclosure herein is used in a vehicle, such as for example a motor vehicle.

Further features of the present invention will become apparent from the following description and the appended claims in conjunction with the figures.

In order to better understand the principles of the present invention, further embodiments are explained in greater detail below based on the FIGS. It should be understood that the invention is not limited to these embodiments and that the features described may also be combined or modified without departing from the scope as defined in the appended claims.

FIG. 1 schematically shows a method for determining applicable traffic regulations for a motor vehicle from the perspective of the motor vehicle. Firstly, the position and direction of movement of the motor vehicle are determined 10. The position and direction of movement of the motor vehicle are then transmitted 11 to a back end by means of a transmission apparatus of the motor vehicle. A history of positions of the motor vehicle may also be transmitted to the back end. In response to the information transmitted to the back end, information concerning the traffic regulations applicable at the position of the motor vehicle are finally received 12 by the transmission apparatus, for example information concerning a speed limit, a right of way or a restriction on overtaking. The transmission 11 of the position and direction of movement of the motor vehicle to the back end is carried out in a cyclical manner or in dependence of information concerning the validity of the traffic regulations, which is included in the information concerning the traffic regulations applicable at the position of the motor vehicle. The information concerning the validity may for example comprise an indicator that the position of the motor vehicle is in or adjacent to a region of an intersection. The querying of the applicable traffic regulations at the back end may then take place with an increased cycle frequency in the presence of the indicator. Equally, the information concerning the validity may also relate to a geographical validity, e.g., a geographical validity that depends on a travel route. The querying of the applicable traffic regulations at the back end is in this case for example carried out again once the geographical validity ceases to apply. In addition, the information concerning the traffic regulations applicable at the position of the motor vehicle may comprise detailed information concerning intersections.

Figure 2:
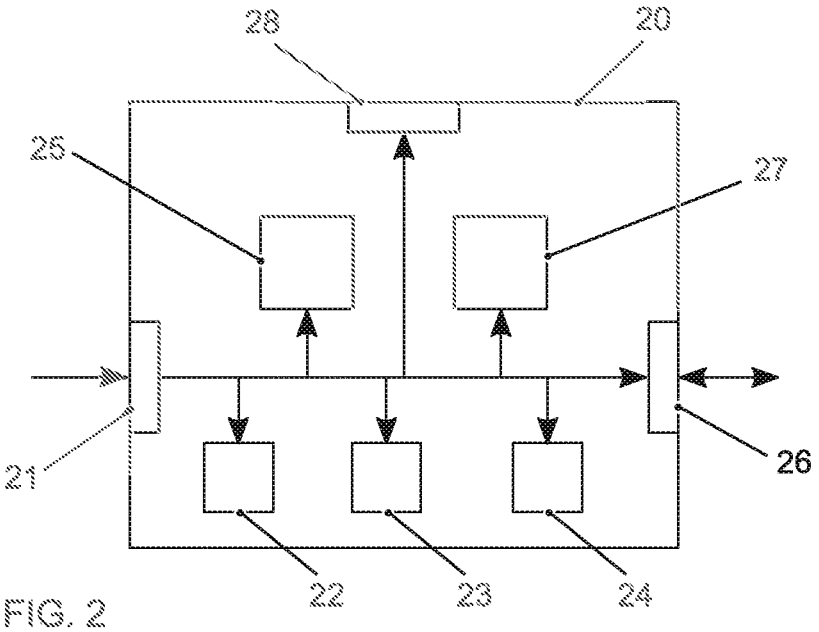
FIG. 2 shows a first embodiment of a device that may be installed in a motor vehicle for determining applicable traffic regulations for a motor vehicle.

FIG. 2 is a simplified schematic view of a first embodiment of a device 20 that may be installed in a motor vehicle for determining applicable traffic regulations for a motor vehicle. The device 20 has an input 21 for receiving information relating to the position and direction of movement of the motor vehicle, for example from a navigation system, or data that make it possible to determine the position and direction of movement of the motor vehicle. A tracking unit 22 extracts or determines the position and direction of movement of the motor vehicle from the received data and selects the data which are to be transmitted to a back end. A transmission apparatus 23 transmits the selected data, i.e., the position and direction of movement of the motor vehicle, to the back end. It may also be possible for the transmission apparatus 23 to transmit a history of positions of the motor vehicle to the back end. In addition, the transmission apparatus 23 receives information concerning traffic regulations applicable at the position of the motor vehicle, for example information concerning a speed limit, a right of way or a restriction on overtaking, from the back end. The transmission apparatus 23 is configured to carry out the transmission of the position and direction of movement of the motor vehicle to the back end in a cyclical manner or in accordance with information concerning the validity of the traffic regulations, which is included in the information concerning the traffic regulations applicable at the position of the motor vehicle. The information concerning the validity may for example comprise an indicator that the position of the motor vehicle is in or adjacent to a region of an intersection. The querying of the applicable traffic regulations at the back end may then take place with an increased cycle frequency in the presence of the indicator. Equally, the information concerning the validity may also relate to a geographical validity, e.g., a geographical validity that depends on a travel route. The querying of the applicable traffic regulations at the back end is in this case for example carried out again once the geographical validity ceases to apply. In addition, the information concerning the traffic regulations applicable at the position of the motor vehicle may comprise detailed information concerning intersections. A data processing unit 24 evaluates the received information concerning the traffic regulations applicable at the position of the motor vehicle. The data generated by the data processing unit 24 are for example provided for further use via an output 26 of the device 20. The tracking unit 22, the transmission apparatus 23 and the data processing unit 24 may be controlled by a control unit 25. If necessary, settings of the tracking unit 22, the transmission apparatus 23, the data processing unit 24 or the control unit 25 may be changed by means of a user interface 28. The data accruing in the device 20 may be stored in a memory 27 of the device 20, for example for later evaluation or for use by the components of the device 20. The tracking unit 22, the transmission apparatus 23, the data processing unit 24 and the control unit 25 may be realized as dedicated hardware, such as integrated circuits. Of course, they can, however, also be partially or completely combined or implemented as software that runs on a suitable processor such as a GPU. The input 21 and output 26 may be implemented as separate interfaces or as a combined bidirectional interface.

Figure 3:
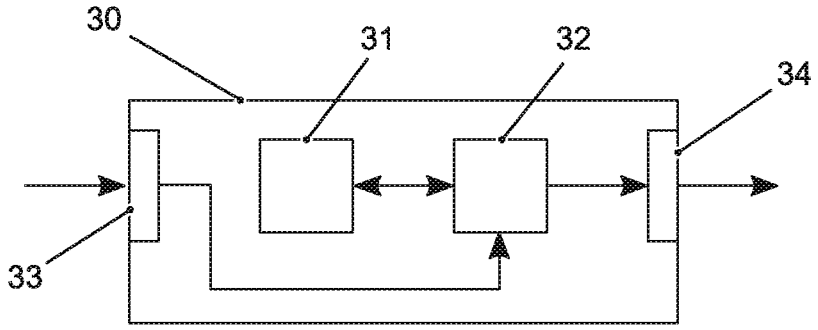
FIG. 3 shows a second embodiment of a device that may be installed in a motor vehicle for determining applicable traffic regulations for a motor vehicle.

FIG. 3 is a simplified schematic view of a second embodiment of a device 30 that may be installed in a motor vehicle for determining applicable traffic regulations for a motor vehicle. The device 30 has a processor 32 and a memory 31. For example, the device 30 is a computer or controller. Instructions are stored in the memory 31 that, when executed by the processor 32, cause the device 30 to execute the steps according to one of the described methods. The instructions stored in the memory 31 thus represent a program that may be run by the processor 32 and that is realized by the method according to the present disclosure. The device has an input 33 for receiving information such as data that were detected by a sensor system of the motor vehicle. Data generated by the processor 32 are provided by an output 34. Moreover, said data may be stored in the memory 31. The input 33 and the output 34 may be combined into a bidirectional interface.

The processor 32 may comprise one or more processor units, for example microprocessors, digital signal processors or combinations thereof.

The memories 27, 31 of the described embodiments may have volatile as well as non-volatile memory regions and may comprise a wide range of memory units and storage media, such as hard disks, optical storage media or semiconductor memories.

Figure 4:
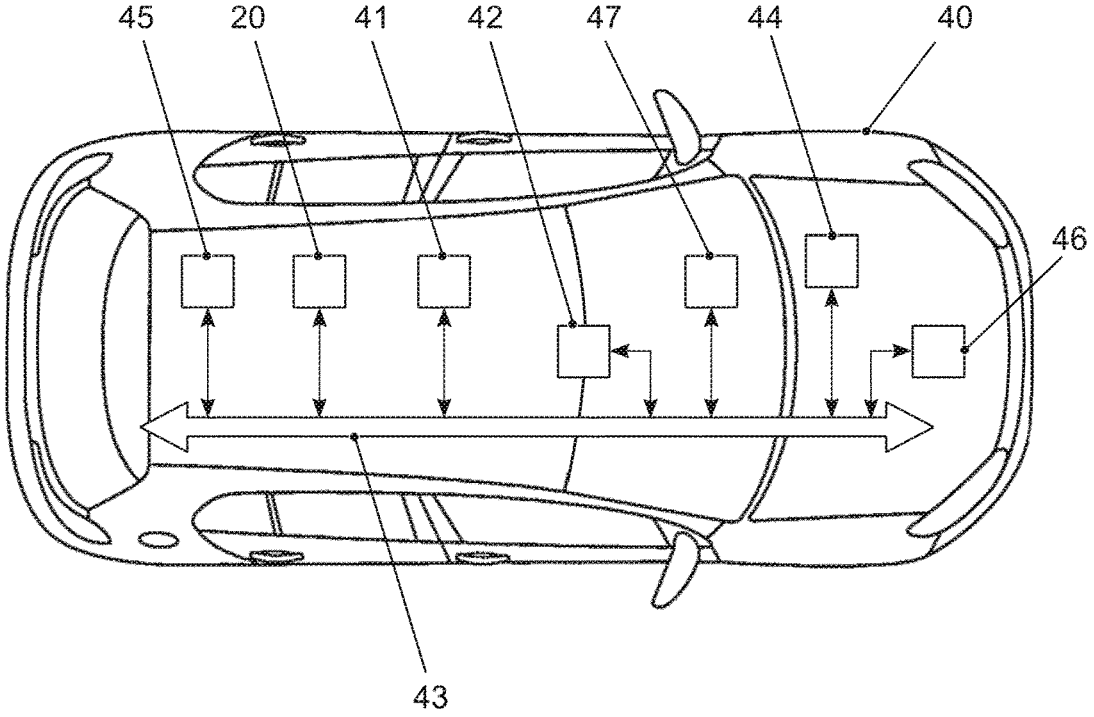
FIG. 4 schematically shows a motor vehicle in which a solution according to an embodiment is realized.

FIG. 4 schematically shows a motor vehicle 40 in which a solution according to the present disclosure is realized. The motor vehicle 40 has, inter alia, a navigation system 41 and a surround sensor system 42 such as a camera system. The data detected by the navigation system 41 and, if applicable, by the surround sensor system 42 are transmitted via a network 43 to a device 20 for determining applicable traffic regulations for the motor vehicle. In addition, said data may be stored in a memory 44 of the motor vehicle 40. If necessary, the data may be transmitted from the device 20 to a back end by means of a communication unit 45 for the purposes of evaluation. The information concerning the traffic regulations applicable to the motor vehicle transmitted by the back end in response to the data sent is relayed to the driver by means of a user interface 47, for example an infotainment system comprising a display device. In addition, said information may be provided to a driver assistance system 46 of the motor vehicle 40, for example for automatically controlling the vehicle speed.

Figure 5:
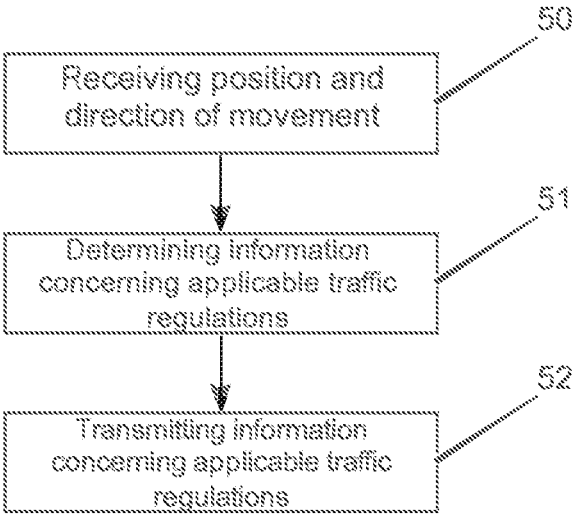
FIG. 5 schematically shows a method for determining applicable traffic regulations for a motor vehicle from the perspective of a back end.

FIG. 5 schematically shows a method for determining applicable traffic regulations for a motor vehicle from the perspective of a back end. In a first step, at least one position and one direction of movement of the motor vehicle are received 50. Based on the information received, information concerning traffic regulations applicable at the position of the motor vehicle, for example information concerning a speed limit, a right of way or a restriction on overtaking, is then determined 51. The information concerning the traffic regulations applicable at the position of the motor vehicle comprises information concerning the validity of the traffic regulations. The information concerning the validity may for example comprise an indicator that the position of the motor vehicle is in or adjacent to a region of an intersection. Equally, the information concerning the validity may also relate to a geographical validity, e.g., a geographical validity that depends on a travel route. In addition, the information concerning the traffic regulations applicable at the position of the motor vehicle may comprise detailed information concerning intersections. The information concerning the traffic regulations applicable at the position of the motor vehicle is finally transmitted 52 to the motor vehicle.

Figure 6:
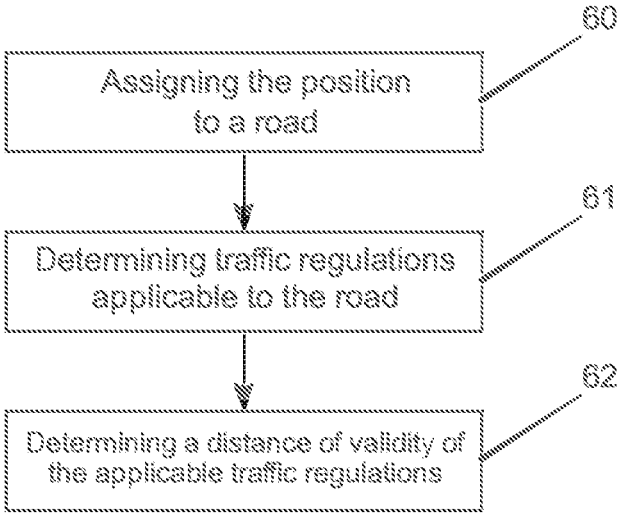
FIG. 6 shows further details for determining the information concerning the traffic regulations applicable at the position of the motor vehicle.

FIG. 6 shows further details for determining the information concerning the traffic regulations applicable at the position of the motor vehicle. In a first step, the position of the motor vehicle is assigned 60 to a road in a road network. Subsequently, the traffic regulations that apply to the road at the position of the motor vehicle are determined 61. In addition, at least one distance of validity is determined 62, i.e., a distance within the road network until a change in the applicable traffic regulations.

Figure 7:
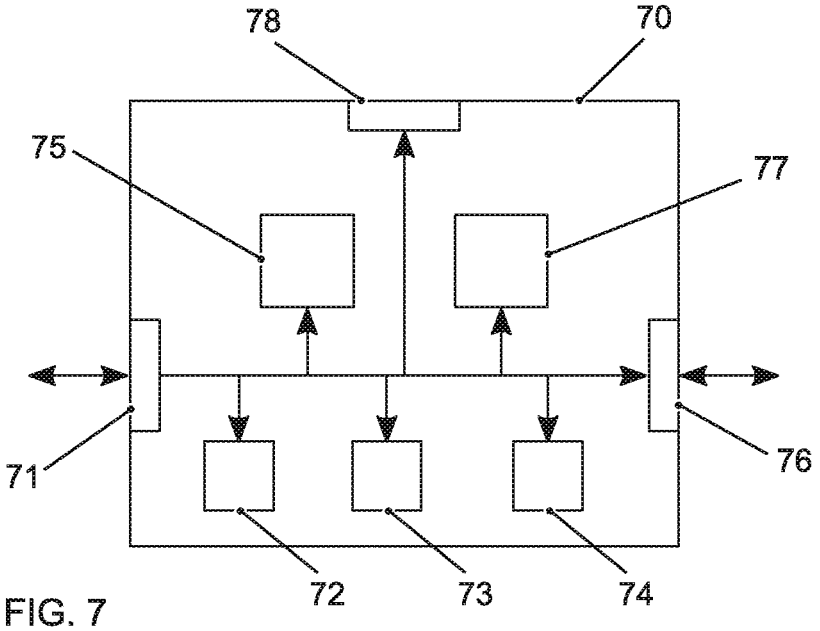
FIG. 7 shows a first embodiment of a device that may be installed in a back end for determining applicable traffic regulations for a motor vehicle.

FIG. 7 is a simplified schematic view of a first embodiment of a device 70 that may be installed in a back end for determining applicable traffic regulations for a motor vehicle. The device 70 has a first interface 71, via which a transmission apparatus 72 may receive information on at least one position and one direction of movement of the motor vehicle. The transmission apparatus 72 may also transmit information concerning the traffic regulations applicable at the position of the motor vehicle, for example information concerning a speed limit, a right of way or a restriction on overtaking, to the motor vehicle via the first interface. Based on the information received by the transmission apparatus 72, a positioning unit 73 locates the motor vehicle on a map. The map may be provided by an external database via a second interface 76. Based on this location, a computing unit 74 determines the desired information concerning the traffic regulations applicable at the position of the motor vehicle. The computing unit 74 is configured to provide the information concerning the traffic regulations applicable at the position of the motor vehicle with information concerning the validity of the traffic regulations. The information concerning the validity may for example comprise an indicator that the position of the motor vehicle is in or adjacent to a region of an intersection. Equally, the information concerning the validity may also relate to a geographical validity, for example a geographical validity that depends on a travel route. In addition, the information concerning the traffic regulations applicable at the position of the motor vehicle may comprise detailed information concerning intersections. The transmission apparatus 72, the positioning unit 73 and the computing unit 74 may be controlled by a control unit 75. If necessary, settings of the transmission apparatus 72, the positioning unit 73, the computing unit 74 or the control unit 75 may be changed by means of a user interface 78. The data accruing in the device 70 may be stored in a memory 77 of the device 70, for example for later evaluation or for use by the components of the device 70. The transmission apparatus 72, the positioning unit 73, the computing unit 74 and the control unit 75 may be realized as dedicated hardware, such as integrated circuits. Of course, they can, however, also be partially or completely combined or implemented as software that runs on a suitable processor such as a GPU. The first interface 71 and the second interface 76 may be implemented as separate interfaces or as a combined bidirectional interface.

Figure 8:
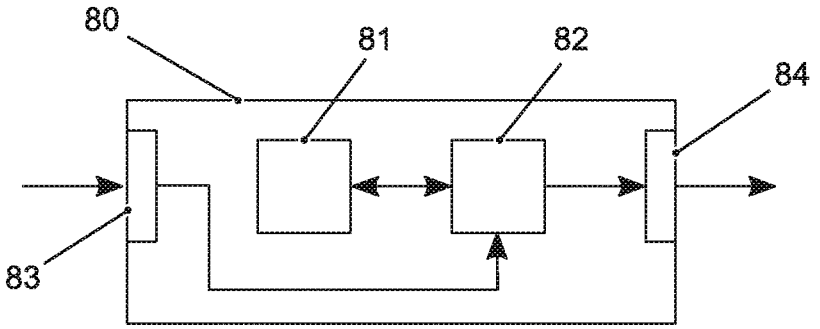
FIG. 8 shows a second embodiment of a device that may be installed in a back end for determining applicable traffic regulations for a motor vehicle.

FIG. 8 is a simplified schematic view of a second embodiment of a device 80 that may be installed in a back end for determining applicable traffic regulations for a motor vehicle. The device 80 has a processor 82 and a memory 81. For example, the device 80 is a computer or a work station. Instructions which, when executed by the processor 82 cause the device 80 to execute the steps according to one of the described methods, are stored in the memory 81. The instructions stored in the memory 81 thus represent a program that may be run by the processor 82 and that is realized by the method according to the present disclosure. The device has an input 83 for receiving information such as a data package that was transmitted by a motor vehicle. Data generated by the processor 82 are provided via an output 84. Moreover, said data may be stored in the memory 81. The input 83 and the output 84 may be combined into a bidirectional interface.

The processor 82 may comprise one or more processor units, for example microprocessors, digital signal processors or combinations thereof.

The memories 77, 81 of the described embodiments may have volatile as well as non-volatile memory regions and may comprise a wide range of memory units and storage media, such as hard disks, optical storage media or semiconductor memories.

In the following, a specific, but exemplary embodiment will be explained with reference to FIG. 9 to FIG. 14. In the example, a speed limit for the vehicle is determined. However, the same principle may be applied to rights of way or restrictions on overtaking, for example. In the case of the application for rights of way, no currently valid speed is transmitted, but rather the status of the road, for example a main road or a side road, and the distance of validity. With regard to restrictions on overtaking, the permissibility of overtaking procedures along with the distance of validity is transmitted, for example permissible, impermissible, impermissible for certain types of vehicle or impermissible with exceptions.

Figure 9:
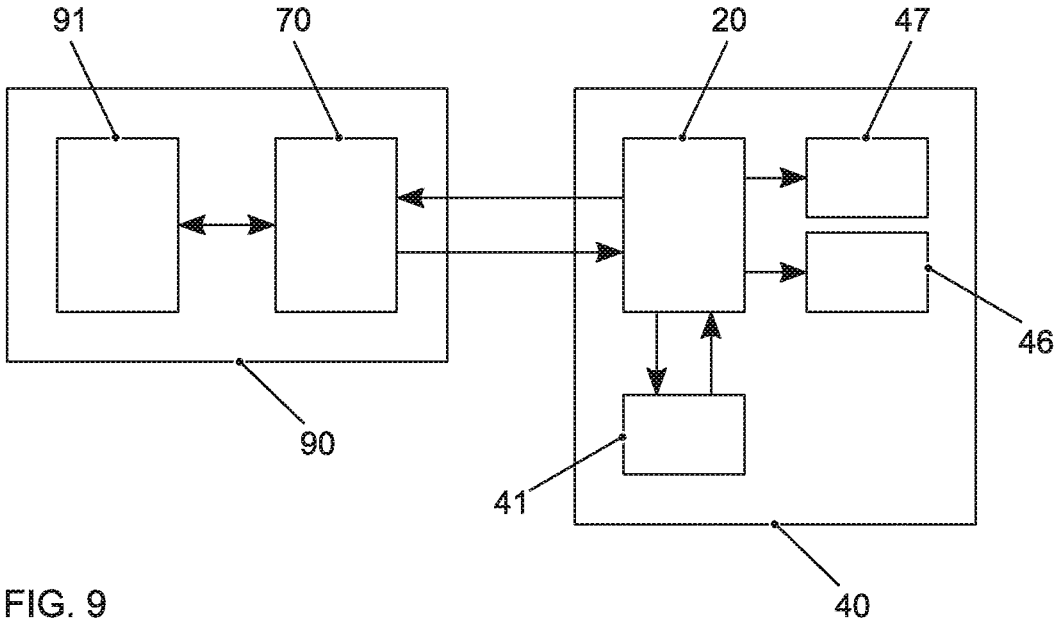
FIG. 9 demonstrates a system for determining applicable traffic regulations for a motor vehicle.

FIG. 9 demonstrates a system for determining applicable traffic regulations for a motor vehicle 40. The system comprises the motor vehicle 40 and a back end 90. In addition to a device 20 for determining applicable traffic regulations, the motor vehicle 40 also has a navigation system 41, a driver assistance system 46 and a user interface 47. The back end comprises at least one device 70 for determining applicable traffic regulations and a database 91 comprising map data and traffic regulation information. The map material may for example be in NDS format (NDS: Navigation Data Standard). The motor vehicle 40 sends its current position along with a trace, i.e., comprising at least one waypoint from the past, and its direction to the back end 90. These data may for example be provided by the navigation system 41. The back end 90 uses this information to assign the motor vehicle 40 to a road. For this purpose, the map material from the database 91 is provided to the device 70 for determining applicable traffic regulations. Based on the assignment, the currently valid speed limit for the motor vehicle 40 is determined and transmitted to the motor vehicle 40. In addition, a distance of validity for the speed limit and at least one subsequent speed limit may be determined and transmitted. This may for example take place in consideration of possible route decisions. The current speed limit determined by the device 20 from the received data may be displayed on a display of the user interface 47. In addition, the speed limit and, if necessary, subsequent speed limits may be provided to the driver assistance system 46. If the subsequent speed limits depend on the route, information on the relevant selected route may be supplied by the navigation system 41 if necessary. In addition, the navigation system 41 may be instructed to restart the position tracking as soon as a request for applicable traffic regulations has been transmitted to the back end 90.

Figure 10:
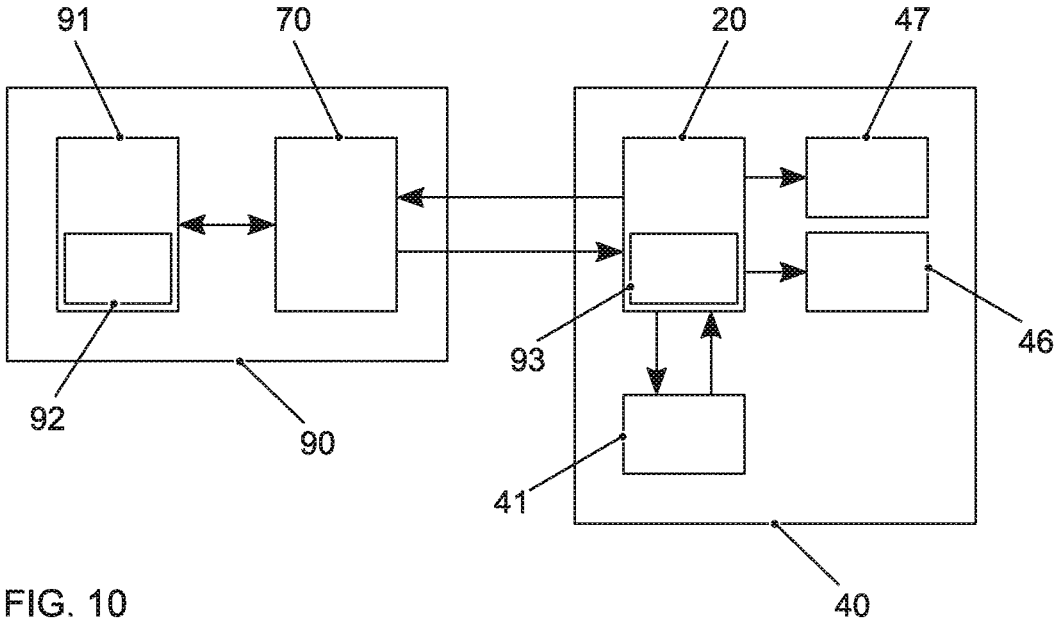
FIG. 10 illustrates two algorithms that may be implemented in the system from FIG. 9.

FIG. 10 illustrates two specific algorithms 92, 93 that may be implemented in the system from FIG. 9. A first algorithm 92 is implemented in the database 91. However, it may also be executed by the device 70 for determining applicable traffic regulations or by a dedicated component of the back end 90. The algorithm 92 is a search algorithm. Said search algorithm determines the speed limit applicable at the position of the motor vehicle 40. Moreover, the search algorithm may be able to determine a minimum, potentially also route-dependent minimum distance until a change in the speed limit. This is explained in greater detail below with reference to FIGS. 12 to 14. Another algorithm 93 is implemented in the device 20 for determining applicable traffic regulations arranged in the motor vehicle 40. This algorithm 93 may also be executed by a dedicated component of the motor vehicle 40 as an alternative. The algorithm for example selects the past waypoints that are to be transmitted to the back end 90. In some embodiments, the past positions may be stored in a ring memory, such that the newest waypoint continuously replaces the oldest already saved waypoint. This way, only a small amount of memory space is required and, at the same time, a continuous trace of the current position is provided. The past waypoints should be at a particular minimum distance from one another in order to be meaningful. Waypoints immediately before and after a lane change are particularly interesting for correct assignment of the vehicle position to a road, and in particular to the right traffic lane in the case of multi-lane roads. Waypoints of this kind are therefore, e.g., transmitted to the back end 90. Since travel around bends in the road may be easily recognized based on the steering angle, information concerning the course of the steering angle may also be provided. Positions at which the steering angle changes, for example when the vehicle enters a bend, travels over a crest or exits a bend, are particularly relevant here. It is also possible to transmit the route curvature, which may be calculated from the steering angle, for each waypoint. Moreover, the detected traffic lane markings (dashed, solid, double line, none) may also be transmitted. With this information, the assignment may be improved further.

The querying of the applicable traffic regulations at the back end 90 may be realized in various ways, some of which will be explained in the following.

According to a first realization variant, the vehicle 40 queries the back end 90 for the current speed limit in a cyclical manner. The cyclical querying may occur at a constant frequency, for example at 1 Hz, or at a constant distance, for example every 0.5 m. This ensures that the vehicle is always informed of the current speed limit, but it creates a not insubstantial volume of data and also requires an almost permanent data connection.

According to a second realization variant, the vehicle 40 also queries the back end 90 in a cyclical manner. However, when the vehicle 40 is in a region of an intersection or in the proximity of a region of an intersection, the back end 90 sends an indicator pointing out an intersection along with the speed limit. In this case, the vehicle 40 queries the back end 90 at a higher frequency until the indicator is reset. This variant increases reliability in regions of intersections, but creates an even larger volume of data than the first realization variant. In addition, an almost permanent data connection is required in this case, too.

According to another variant, the vehicle 40 initially queries the back end 90 for the current speed limit. The back end 90 determines the current speed limit as well as the minimum distance until a change in the speed limit using the search algorithm 92. Both items of information are transmitted to the vehicle 40. The vehicle 40 tracks the route covered, for example using vehicle sensors, and queries the back end 90 again for the speed limit when it reaches the transmitted minimum distance. This variant requires a very small number of queries, and therefore the volume of data accrued is very small. In addition, no permanent data connection is required. Instead of the minimum distance until a change in the speed limit, several distances for various possible routes may be transmitted. In other words, the shortest distance until a change in the speed limit is stored subject to the directional constraint of the first encountered intersection. To give an example, if the vehicle 40 turns left at the first intersection in 500 m, the next change is at a distance of 525 m. If the vehicle 40 carries straight on at the first intersection in 500 m, the next change is at a distance of 751 m. If the vehicle 40 turns right at the first intersection in 500 m, the next change is at a distance of 612 m. In this case, the vehicle 40 not only monitors the distance covered, but also the selected route.

Figure 11:
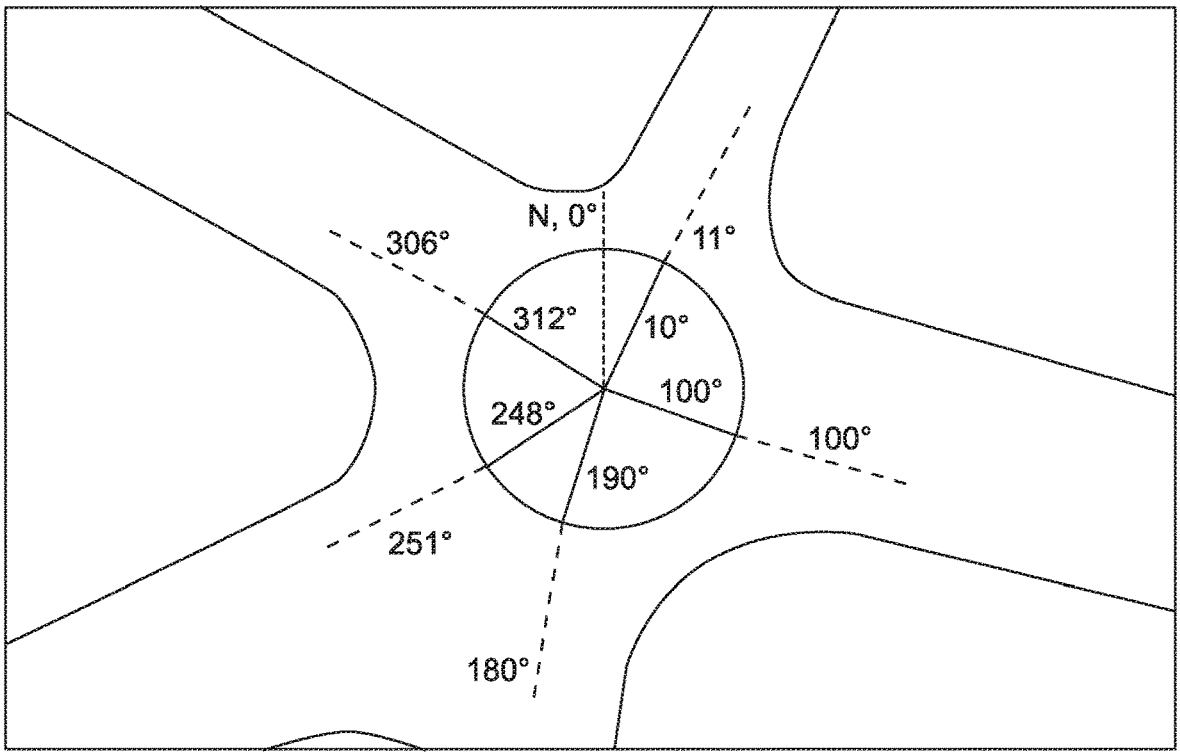
FIG. 11 shows an intersection model that may be transmitted to a motor vehicle as part of information concerning applicable traffic regulations.

According to another variant, the back end 90 transmits a simple intersection model in addition to the current speed limit and the distances until a change in the speed limit. An example of an intersection model of this kind is shown in FIG. 11. The intersection is represented by a circle that shows the intersection area. The intersection arms leading off are represented by their position on the circular ring and by the direction of the arm. For example, the position on the circular ring is given by the location in degrees with respect to the center of the intersection, whereas the compass direction in degrees is used for the direction of the arm. The vehicle 40 may decide which intersection arm is being taken based on its own direction. An alternative intersection model uses GPS points to represent the intersection arms. By comparing the vehicle position with the GPS points, the vehicle 40 may determine the affiliation to an intersection arm. Furthermore, it is possible for the back end 90 to transmit an intersection network for a defined radius. The vehicle 40 then determines its own location autonomously within this network and from this determines the current speed restriction. By virtue of the intersection models or respectively the intersection network, a certain degree of pre-emption is possible in the event of latencies in the back end querying process, as a result of which the reliability of the method is increased.

Figure 12:
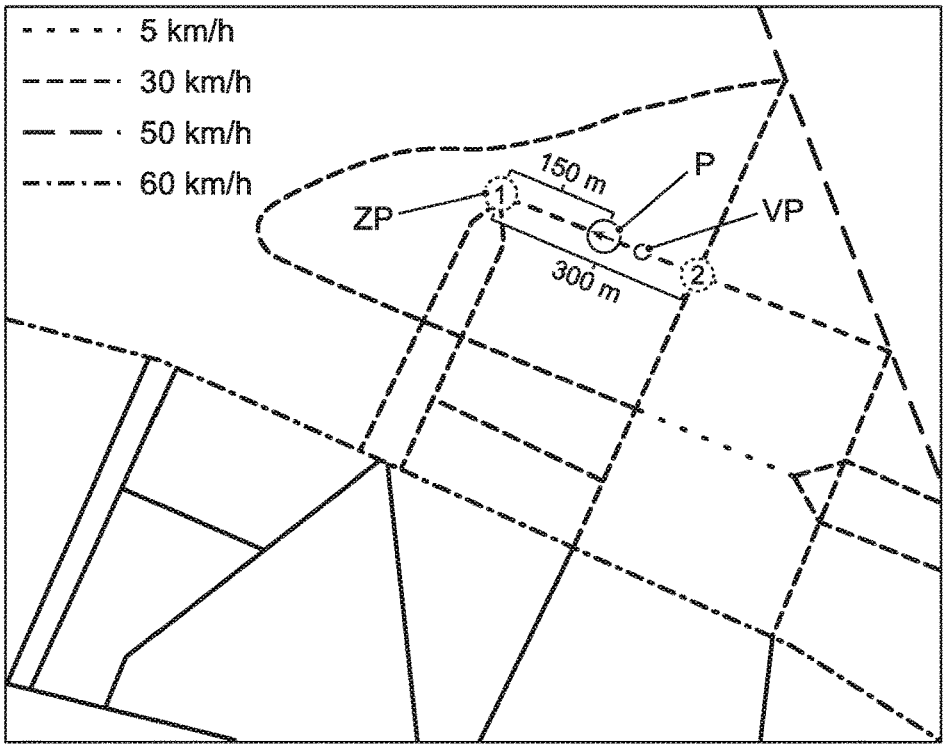
FIG. 12 demonstrates a first iteration step in a determination of a distance of validity of a speed limit.

FIG. 12 demonstrates a first iteration step in a determination of a distance of validity of a speed limit. A portion of a road network is shown, the roads being represented by solid and dashed lines. The type of dashing represents the corresponding speed limit. Roads with a solid line are the roads which are of no relevance to the given position of the vehicle. The search carried out in the road network corresponds to a tree search. The road network splits in several directions. The shortest route to a change in speed in this network is sought. The vehicle is at a position P, which is shown by a circle. The arrow in the circle represents the direction of travel. Another circle VP highlights a previous position of the vehicle. The vehicle is currently on a stretch of road between two intersections "1" and "2", which may be possible future positions ZP of the vehicle. The speed limit on this stretch of road is 30 km/h. Firstly, the distance to the next intersection "1" in the direction of travel is determined. In addition, the distance to the next intersection "2" counter to the travel direction is determined, a turning maneuver at the next intersection "1" in the direction of travel being assumed.

The distance to the intersection "1" is 150 m in the example, and the distance to the intersection "2" is 450 m. The speed limit does not change on the stretches of road to the two intersections.

Therefore, in any event, the minimum distance until a change in the speed limit is greater than 150 m. The current stretch of road is now marked as having already been used for the search.

Figure 13:
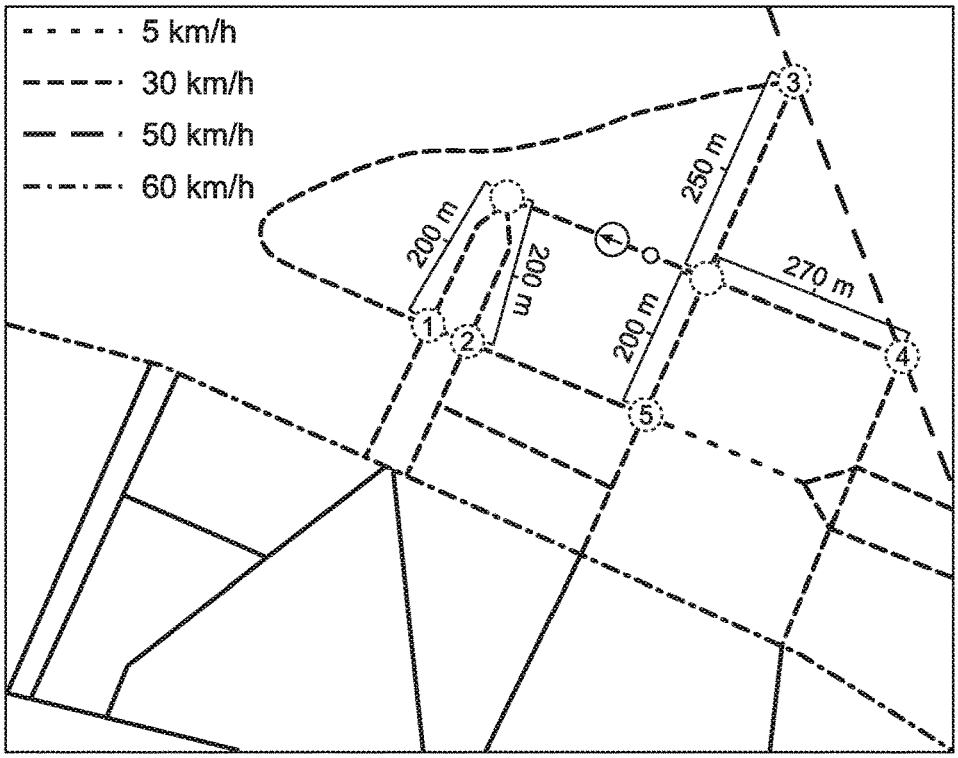
FIG. 13 demonstrates a second iteration step in the determination of a distance of validity of a speed limit.

FIG. 13 demonstrates a second iteration step in the determination of a distance of validity of a speed limit. Since no change in the speed limit was found, the search for other intersections at which the speed limit could change is continued. Five other intersections "1" to "5" may be reached proceeding from the intersections found in the first iteration. Already used street sections are disregarded in this search if the speed limit applies in both directions and if the current route is shorter than the route already used. The distance to the intersections "1", "2" and "5" is in each case 200 m, the distance to the intersection "3" is 250 m, and the distance to the intersection "4" is 270 m. The speed limit does not change on the street sections to the intersections. Therefore, in any event, the minimum distance until a change in the speed limit is greater than 350 m, i.e., greater than the distance from the starting position P to the intersections "1" or "2". The current street sections are now marked as having already been used for the search.

Figure 14:
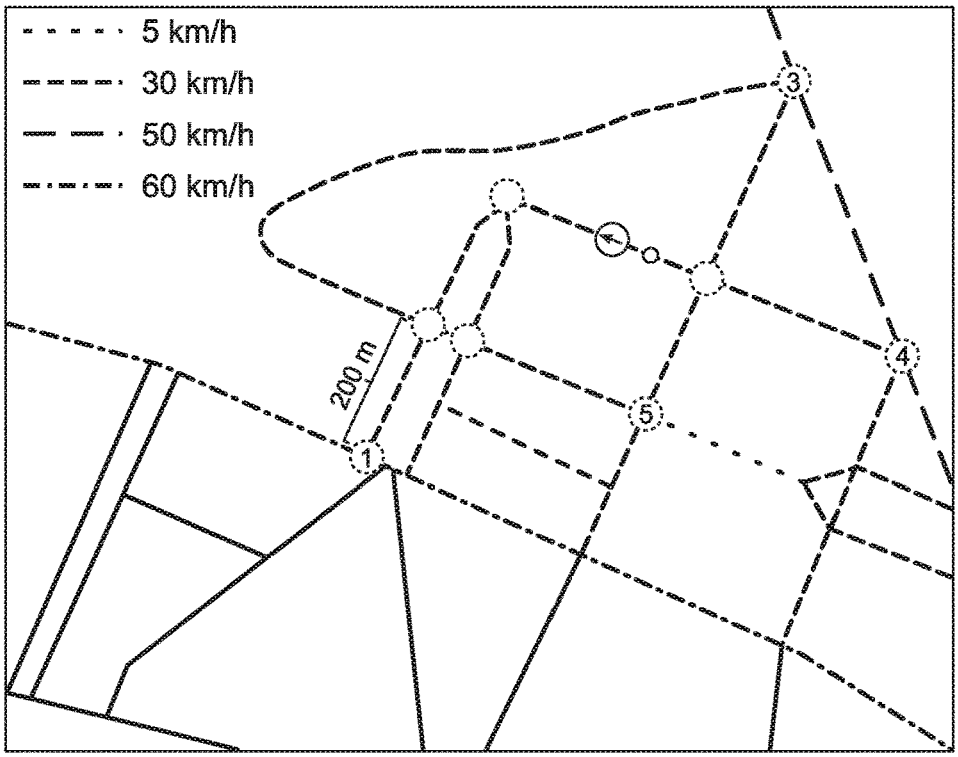
FIG. 14 illustrates an end result of the determination of a distance of validity of a speed limit.

FIG. 14 illustrates an end result of the determination of a distance of validity of a speed limit. After a few iterations, the search result is as follows. At the intersection "1", the speed limit changes to 60 km/h after a total of 550 m. At the intersection "3", the speed limit changes to 50 km/h after a total of 700 m. At the intersection "4", the speed limit changes to 50 km/h after a total of 720 m. At the intersection "5", the speed limit changes to 5 km/h after a total of 650 m.

REFERENCE NUMBER LIST

10 Determining position and direction of movement
11 Transmitting position and direction of movement
12 Receiving information concerning applicable traffic regulations
20 Device

21 Input
22 Tracking unit
23 Transmission apparatus
24 Data processing unit
25 Control unit
26 Output
27 Memory
28 User interface
30 Device
31 Memory
32 Processor
33 Input
34 Output
40 Motor vehicle
41 Navigation system
42 Surround sensor system
43 Network
44 Memory
45 Communication unit
46 Driver assistance system
47 User interface
50 Receiving position and direction of movement
51 Determining information concerning applicable traffic regulations
52 Transmitting information concerning applicable traffic regulations
60 Assigning the position to a road
61 Determining traffic regulations applicable to the road
62 Determining a distance of validity of the applicable traffic regulations
70 Device
71 First interface
72 Transmission apparatus
73 Positioning unit
74 Computing unit
75 Control unit
76 Second interface
77 Memory
78 User interface
79 Database
80 Device
81 Memory
82 Processor
83 Input
84 Output
90 Back end
91 Database
92 Search algorithm
93 Algorithm
P Position
VP Previous position
ZP Future position The invention has been described in the preceding using various exemplary embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module or other unit or device may fulfil the functions of several items recited in the claims.

The mere fact that certain measures are recited in mutually different dependent claims or embodiments does not indicate that a combination of these measures cannot be used to advantage. Any reference signs in the claims should not be construed as limiting the scope.

What is claimed is:

1. A method for determining applicable traffic regulations for a motor vehicle, comprising:

transmitting at least one position and one direction of movement of the motor vehicle to a back end using a transmission apparatus of the motor vehicle; and in response, receiving, using the transmission apparatus, information concerning traffic regulations applicable at the position of the motor vehicle, and additionally receiving validity information concerning the traffic regulations, the validity information comprising at least a minimum distance in the direction of movement of the motor vehicle to a point where a change in traffic regulations occurs;

repeating transmitting the at least one position and the one direction of movement of the motor vehicle to the back end when the vehicle is close to the point where the change in traffic regulations occurs to keep the required volume of data to be transmitted small.

2. The method of claim 1, wherein a history of positions of the motor vehicle is transmitted to the back end.

3. The method of claim 1, wherein the validity information comprises an indicator that the position of the motor vehicle is in or adjacent to a region of an intersection.

4. The method of claim 1, wherein the validity information relate to one or more of a geographical validity and a geographical validity that depends on a travel route.

5. The method of claim 4, wherein the transmission of at least one position and one direction of movement of the motor vehicle to the back end is carried out again when the geographical validity ceases to apply.

6. The method of claim 1, wherein the information concerning the traffic regulations applicable at the position of the motor vehicle comprises detailed information relating to at least one intersection.

7. The method of claim 1, wherein the traffic regulations applicable at the position of the motor vehicle relate to a speed limit, a right of way or a restriction on overtaking.

8. A non-transitory computer-readable storage medium comprising instructions that, when executed by a computer, cause the computer to execute the steps of the method of claim 1 for determining applicable traffic regulations for a motor vehicle.

9. A motor vehicle, configured to execute a method according to claim 1 for determining applicable traffic regulations.

10. The method of claim 1, a transmission interval of transmitting the at least one position and the one direction of movement of the motor vehicle to a back end is dependent on the validity information.

11. The method of claim 1, wherein an increased cycle frequency is used for the transmission of at least one position and one direction of movement of the motor vehicle to the back end if the position of the motor vehicle is in or adjacent to a region of an intersection.

12. The method of claim 1, wherein, in case the vehicle is approaching an intersection, the information concerning the traffic regulations applicable at the position of the motor vehicle comprises a simple intersection model comprising one or more intersection arms leading off the intersection, wherein each intersection arm is associated with one or more applicable traffic regulations.

13. A method for determining applicable traffic regulations for a motor vehicle, comprising:

receiving at least one position and one direction of movement of the motor vehicle;

in response, determining information concerning the traffic regulations applicable at the position of the motor vehicle and determining validity information concerning the traffic regulations, the validity information comprising at least a minimum distance in the direction of movement of the motor vehicle to a point where a change in traffic regulations occurs; and transmitting the information concerning the traffic regulations applicable at the position of the motor vehicle to the motor vehicle and transmitting the validity information; wherein the traffic regulations applicable at the position of the motor vehicle relate to a right of way or a restriction on overtaking.

14. The method of claim 13, wherein the determination of the information concerning the traffic regulations applicable at the position of the motor vehicle and the determination of the validity information comprises:

assigning the position of the motor vehicle to a road in a road network;

determining traffic regulations applicable to the road at the position of the motor vehicle; and determining at least one distance within the road network until a change in the applicable traffic regulations.

15. The method of claim 13, wherein the validity information comprise an indicator that the position of the motor vehicle is in or adjacent to a region of an intersection.

16. The method of claim 13, wherein the validity information relate to one or more of a geographical validity and a geographical validity that depends on a travel route.

17. A non-transitory computer-readable storage medium comprising instructions that, when executed by a computer, cause the computer to execute the steps of the method of claim 13 for determining applicable traffic regulations for a motor vehicle.

18. A device for determining applicable traffic regulations for a motor vehicle, comprising:

a transmission apparatus for transmitting at least one position and one direction of movement of the motor vehicle to a back end and for receiving information concerning the traffic regulations applicable at the position of the motor vehicle, which information concerning the traffic regulations comprises validity information concerning the traffic regulations, wherein the validity information comprising at least a minimum distance in the direction of movement of the motor vehicle to a point where a change in traffic regulations occurs; and a data processing unit for evaluating the information concerning the traffic regulations applicable at the position of the motor vehicle;

wherein the transmission apparatus is configured to repeat transmitting the at least one position and one direction of movement of the motor vehicle to the back end when the vehicle is close to the point where the change in traffic regulations occurs.

19. A motor vehicle, comprising a device according to claim 18 for determining applicable traffic regulations.

20. A device for determining applicable traffic regulations for a motor vehicle, comprising:

a transmission apparatus for receiving at least one position and one direction of movement of the motor vehicle and for transmitting information concerning the traffic regulations applicable at the position of the motor vehicle to the motor vehicle; and a computing unit for determining the information concerning the traffic regulations applicable at the position of the motor vehicle and for determining validity information concerning the traffic regulations, the validity information comprising at least a minimum distance in the direction of movement of the motor vehicle to a point where a change in traffic regulations occurs;

wherein the computing unit is configured to provide the information concerning the traffic regulations applicable at the position of the motor vehicle with the validity information; and wherein the traffic regulations applicable at the position of the motor vehicle relate to a right of way or a restriction on overtaking.

* * * * *